US006040014A

United States Patent [19]

Izmirlian et al.

[11] Patent Number: 6,040,014

[45] Date of Patent: Mar. 21, 2000

[54] FABRIC TREATMENT COMPOSITION

[76] Inventors: Avedik Izmirlian, 110 E. 9th St., Suite C602, Los Angeles, Calif. 90079; Attilio del Verme, 359 Lexington Ave., Clifton, N.J. 07011

[21] Appl. No.: 09/176,535

[22] Filed: Oct. 21, 1998

Related U.S. Application Data

[60] Provisional application No. 60/063,023, Oct. 23, 1997.

[51] Int. Cl.[7] ..... C09B 67/00

[52] U.S. Cl. ..... 427/358; 8/495; 8/552; 8/581; 8/580; 427/389.9; 427/394

[58] Field of Search ..... 427/389.9, 387, 427/394, 358; 8/495, 552, 581, 580

[56] References Cited

U.S. PATENT DOCUMENTS 4,119,398 10/1978 Purser .
4,559,056 12/1985 Leigh et al. .
4,740,496 4/1988 Vanier .
4,943,431 7/1990 Awamura et al. .
4,978,363 12/1990 Ona et al. .
5,810,889 9/1998 Kaufmann et al. .

*Primary Examiner*—Margaret Einsmann
*Attorney, Agent, or Firm*—Colin P. Abrahams

[57] ABSTRACT

A fabric treatment composition comprises a fatty acid and a silicone elastomer, wherein the composition is used as a pretreatment for the fabric prior to application of ink thereto to facilitate retention and resolution of the ink on the fabric. The composition may also comprise a polyethylene glycol stearate and a fatty acid condensation product. The invention also describes a method of treating a fabric prior to printing thereon with an ink, the method comprising locating the fabric on a frame or base, applying a treatment composition comprising a polyethylene glycol stearate and a silicone elastomer to the fabric, and drying the fabric immediately thereafter. The invention further is for a method of preparing a fabric treatment composition.

23 Claims, No Drawings

FABRIC TREATMENT COMPOSITION

CROSS REFERENCE TO RELATED APPLICATIONS

This application claims the benefit under 35 U.S.C. 119(e) of U.S. Provisional Application Serial No. 60/063,023 filed on Oct. 23, 1997.

FIELD OF THE INVENTION

This invention relates to compositions for treating both natural and synthetic fabrics, and a method of treating such fabrics by applying thereto the composition. Particularly, the composition and method of treatment of fabrics have an application in pretreating a fabric prior to applying a pattern or design thereon in order that the fabric will better show the pattern, and so that the pattern will be clearer and have improved resolution and brilliance. The invention is also for a method of preparing a fabric treatment composition. The invention is typically used in conjunction with printing on fabrics with the use of inkjet printers, thermal, piexo, picto, or laser printers, copiers, etc. These are referred to as "printers" or "inkjet printers" herein. These printers can be of any of the following types: manual or ADF, drum, plain sheet or continuous.

BACKGROUND OF THE INVENTION

The concept of printing various cloths with dyes to form patterns is well known. In some instances, the printed cloth may not accept the ink optimally which could result in poor resolution and the immediate or subsequent fading of the pattern on the cloth. This is particularly true when it comes to printing designs or patterns on a cloth directly from a printer.

Problems may arise in cloth treatment when a design, prepared for example on a computer using CAD software, is desired to be directly printed from the screen to the fabric. Usually, it has been necessary to use intermediate devices, such as screens or heat transfer sheets, in order to ensure that brilliance of the pattern on the cloth is achieved and retained. Otherwise, design fading and a washed out appearance is likely to occur.

There are number of patents which describe types of ink and coating compositions which are intended to improve the sharpness and durability of inks printed onto different types of fabrics using printers. Some of these are briefly discussed below.

U.S. Pat. No. 5,594,485 (Koike) discloses an ink-jet textile printing method. In this patent, the cloth or fabric may contain a certain proportion of water soluble high molecular weight polymers as well as synthetic high polymers. These may include various celluloses, polysacharrides and protein substances.

U.S. Pat. No. 4,702,742 (Iwata) describes aqueous jet-ink printing on textile fabric pre-treated with a polymeric acceptor. An acceptor for the ink is deposited on the surface of the cloth to facilitate easy and rapid absorbing and accepting of the ink. Various acceptor materials are provided, and these may include water soluble or hydrophilic natural or synthetic polymers. When ink is applied, it is absorbed and accepted by the ink acceptor. The ink composition itself may contain various dispersants, surfactants and viscosity controlling agents.

U.S. Pat. No. 4,119,398 (Purser) also describes a composition for pre-treating fabric for use in transfer printing and transfer printing processes. This patent does not address the issue of enhanced printing from ink-jet printers, which requires specialized processes. The invention is mainly directed towards improvement of fabric coatings which do not readily retain dyes by transfer printing, and the composition comprises a self-curing acrylic resin and one of a softening agent or self-curing elastomeric polysiloxane composition. Various other components, such as wetting agents, humectants, and the like may also be added.

U.S. Pat. No. 3,936,542 (Cox) describes a method of incorporating a stable resin binder composition into print bonding. A very large variety of synthetic resins may be used, and the patent also sets forth self-thickening resins which may be used.

U.S. Pat. No. 4,806,391 (Shorin) describes a silicone-based hydrophobic coating composition which can be made into printable coatings. These silicone-based solventless hydrophobic compositions are based on vinyl or hydroxyl chainstopped polysiloxanes having viscosities within specified limits. Various polysiloxanes are used in the composition for printing inks and varnishes.

U.S. Pat. No. 5,352,503 (Drake) describes a paper comprised of a substrate and a coating. The coating includes a pigment and a binder. The binder may include polyethylene glycol. One of the significant objects of the invention is to avoid the problem of curl, particularly upon a change of relative humidity.

U.S. Pat. No. 5,501,902 (Kronzer) is for a printable material including first and second layers. The first layer is typically a sheet material, such as film, paper, non-woven and woven wefts, while the second layer consists of a number of components including humectants such as polyethylene glycol, viscosity modifiers, and particles of a thermoplastic polymer. It is to be noted that the second layer is applied typically to the side of the paper not having the print coating.

U.S. Pat. No. 5,396,275 (Koike) addresses problems in printing on cloth by an ink-jet printer, some of the problems relating to sharpness, high density and high brightness. This patent addresses the problem by adjusting the moisture content of the cloth, applying ink to this adjusted cloth of predetermined density, dying the cloth including the use of heat treatment, and washing out the remaining dye. The printing ink itself may include an organic solvent, a large number of examples of which are provided, and which include various glycols.

U.S. Pat. No. 5,515,093 (Haruta) describes the use of cationic substances, contained in a cloth so that printing can be conducted on the variety of types of cloth with an ink which is ordinarily used in commercially available ink-jet printers. The cationic substance may be comprised of an amine, the use of a cationic inorganic particle with a binder, and the application of an anionic dyable polymer.

U.S. Pat. No. 4,969,951 (Koike) describes a liquid composition for ink-jet printing. This ink-jet liquid includes a disperser dye in an aqueous liquid medium. The patent also covers imparting a liquid composition onto a cloth and then subjecting the cloth to dye-fixing treatment. The composition contains a number of different agents including organic solvents, dispersing agents, viscosity controlling agents and defoaming agents. The organic solvent includes various glycols; the dispersing agents or surfactants include fatty acid salts, condensates, ethers and esters; and viscosity controlling agents include sodium polyacrylate and other natural or synthetic polymers.

U.S. Pat. No. 5,631,684 (Takaide) describes an ink-jet textile printing system including the use of disperse dyes.

The invention uses at least two types of ink on a cloth, these two types of ink overlapping, being heat-treated and thereafter washed. The inks contain dyes and a compound for dispersing the dyes.

SUMMARY OF THE INVENTION

According to one aspect of the invention, there is provided a fabric treatment composition comprising a fatty acid and a silicone elastomer, wherein the composition is used as a pretreatment for the fabric prior to application of ink thereto to facilitate retention and resolution of the ink on the fabric. The composition may further comprise water. Preferably, the fatty acid is polyethylene glycol stearate, and the silicone elastomer is a functional polysiloxane emulsion. This composition can be used to advantage on both natural and synthetic fibers and fabrics. It has particular application with respect to natural fibers and fabrics. In this specification, by silicone is meant a polymer of at least silicon and oxygen.

The composition may further comprise a thickening agent, which may be a polyacrylate, preferably in the form of an emulsion. The composition may also further comprise an antimigrant for controlling mobility of dye particles, and the antimigrant may be a synthetic resin, preferably one selected from the group consisting of vinyl ethers, vinyl halides, vinyl esters and polyacrilic resins.

In a preferred embodiment, the polyacrylate emulsion is present in the amount of about 1% to about 20% by weight, preferably about 5% by weight; the polyethylene glycol stearate is present in the amount of about 0.1% to about 10% by weight, preferably about 0.5% by weight; the antimigrant is present in the amount of about 1% to about 20% by weight, preferably about 2% by weight; the polysiloxane emulsion is present in the amount of about 30% to about 90% by weight, preferably about 75% by weight; and the water is present in the amount of about 5% to about 50% by weight, preferably about 18% by weight.

The composition is applied to a fabric upon which a design or pattern is printed directly thereon by a printer. The fabric may be backed with a removable backing material to facilitate application of a design or pattern on the fabric. The backing material is preferably applied using a glue selected for its ability to leave the fabric residue free after the removal thereof.

According to another aspect of the invention, there is provided a fabric treatment composition comprising a polyethylene glycol stearate and a fatty acid condensation product, wherein the composition is used as a pretreatment for the fabric prior to application of ink thereto to facilitate retention and resolution of the ink on the fabric. In this aspect, the composition has particular application with respect to synthetic fibers and fabrics.

According to another aspect of the invention, there is provided a method of treating a fabric prior to printing thereon with an ink, the method comprising locating the fabric on a frame or base, applying a treatment composition comprising a polyethylene glycol stearate and a silicone elastomer to the fabric, and drying the fabric immediately thereafter. Preferably, the fabric is further located adjacent a screen having a mesh with pores therein, the treatment composition being applied so as to fill the screen with said composition.

The drying may take place at a temperature of about 250° F. to 280° F. for about one minute, after which the fabric is passed through a frame, and is held under tension in the frame.

In another aspect, the invention is a method of preparing a fabric treatment composition comprising introducing into a mixer a polysiloxane emulsion and a polyethylene glycol stearate to form a paste, and maintaining the mixture in the mixer for about 20 to 30 minutes with the mixer operating at about 3500 to 5000 rpm. Antimigrant, water and polyacrylate emulsion are preferably added to the mixture, which may be prepared to have a viscosity of between 2000 and 4000 cps.

DETAILED DESCRIPTION OF THE INVENTION

The present invention provides compositions which may be used on natural or synthetic fabrics as a pre-treatment before printing occurs. The invention facilitates direct printing, without the use of an intermediary medium, from computer screen to the fabric using, for example, a printer, such that the inks on the fabric are received and retained to provide brilliance, durability, and high resolution designs.

Preferably, the inks used in the printer, preferably an inkjet printer, are resistant to bleed or diffusion thereof on or in the fabric, and, further, are designed so as to prevent or effectively eliminate any fade after application thereof to the fabric. The composition enhances the effect and action of the ink on the fabric, particularly with respect to brilliance and high resolution of colors, and this may be achieved by ensuring that the ink is not absorbed into the fabric, thereby causing it to "run". Preferably, the process of the composition application is carried out with a very good penetration and coverage, so deep that sometimes it goes all the way through to the other side. This is more likely to occur in not very tight fabrics. When these fabrics are printed, the ink acts in the same way; it goes almost all the way through. At that stage, the composition acts in every area (all the way through) and has the same properties, avoiding bleeding and making the printed fabric look closer to the actual conventional fabric, even if viewed from the backside.

Additionally, the composition of the invention allows the superimposition of colors printed on a fabric without, or with substantially reduced, bleeding. Dyes and inks which are not colorfast may be used with improved results, at least at this stage of the treatment of the fabric, by virtue of the presence of the composition.

In one aspect, the invention is for a composition which comprises at least a fatty acid, such as polyethylene glycol stearate, and a silicone elastomer, for example a functional polysiloxane emulsion. The composition may also comprise water. Such a composition has been found to work well with natural fibers and fabrics.

In another aspect, the invention is for a composition which comprises a fatty acid, such as polyethylene glycol stearate, and a preferably nonionic fatty condensation product. Such a composition has been found to work well with synthetic fabrics.

The composition may further include a thickening agent such as polyacrylate, which is preferably used in the form of a polyacrylate emulsion. Any suitable polyacrylate may be used in the emulsion.

The composition may also include an antimigrant for controlling the mobility of dye particles in aqueous systems and for preventing migration of the dyes during the drying or thermofixation process. The antimigrant may be any one of a large number of synthetic resins, such as vinyl ethers, vinyl halides, vinyl esters, polyacrilic resins etc.

In other aspects, the invention is also for a method of making the composition, and a method of applying the composition to a fabric.

EXAMPLE

In one embodiment, the composition comprises a polyacrylate emulsion, polyethylene glycol stearate, an antimigrant component, a polysiloxane emulsion, and water. Preferably, the antimigrant used is Superclear® 320-N, manufactured by Ameritex of Santa Fe Springs, Calif. The fatty acid may comprise a salt or ester of stearic acid, and any one of a number of suitable stearates may be used in the composition. Fatty acid condensation products may be used in the composition of the invention in place of the polysiloxane emulsion when synthetic fabrics are being coated.

In one embodiment, the composition may have: about 1% to about 20% by weight of polyacrylate emulsion, preferably about 5% by weight; about 0.1% to about 10% of a fatty acid such as polyethylene glycol stearate, preferably about 0.5% by weight; about 1% to about 20% Superclear 320-N antimigrant, or an equivalent thereof, preferably about 2% by weight; about 30% to about 90% by weight of the polysiloxane emulsion, preferably about 75% by weight; and about 5% to about 50% by weight of water, preferably about 16% to about 18% by weight.

The composition is prepared by mixing the ingredients in a high powered mixer to form a paste, which preferably has a viscosity of between about 2000–4000 cps. A preferable order of introducing the ingredients into the high powered mixer is as follows: polysiloxane emulsion; polyethylene glycol stearates; Superclear 320; water; and polyacrylate emulsion.

The components are maintained in the mixer for about 20 to 30 minutes, with the mixer operating at about 3500 to 5000 rpm. The various components may be present in the proportions approximately set out above, although the relative proportions may vary by 20% to 30% thereof.

The fabric on which it is desired to print a design or pattern directly from a printer, preferably an inkjet printer, is treated with the composition. In a preferred embodiment, the composition is applied to a PFP fabric, preferably a white PFP fabric, when on a rotary printer with an open screen. It is to be noted that PFP fabric is the untreated fabric before any inks, composition of the invention or other additives have been applied to it. The PFP fabric is then coated and dyed with inks in the manner described herein.

In the screen, the pores of the mesh are left open in the areas to be coated. The screen is filled with the composition, and pushed through the open mesh with a squeegee, magnetic bar, rod or other suitable instrument, in order to apply the composition to the fabric. Sometimes, two screens are used in the process, one after the other, so that if there is any area that the first screen was unable to, or did not, cover, the second screen will cover it. Application may be at the rate of 25 to 30 yards per minute. The fabric with applied composition is subjected to immediate drying, at 250 to 280° F., for about one minute. The fabric is passed through a frame adjacent the rotary printer while under tension, and at the about same temperature as the drying temperature.

The polysiloxane may be any one of a number of commercially available products. Leomin WA, or Leomin WMA-T New, manufactured by Dystar L.P. of Charlotte, N.C., has been found to be effective. However, products such as EM-350 manufactured by Ferro Corp. of Hammond, Ill., or Drewplus L-418 manufactured by Drew Industrial Div of Boonton, N.J., are alternative products which may be equally effective.

The polyethylene glycol stearate used may be Spectrasperse Lubricant NA7460, a product manufactured by SpectraChem Corporation of Paterson, N.J. Alternative products which may be used are, however, available, and substitutes include Alkamuls sold by Rhone-Poulenc of Cranbury, N.J., or Troysol G148 manufactured by Troy Chemical Corp, East Hanover, N.J.

The fatty acid condensation product which may be used in the composition of the invention is Fibramoll® NI Conc, a product of Clariant Corporation located in Charlotte, N.C.

A typical polyacrylate emulsion which may be suitable is Imperon Concentrate LV-5 manufactured by DyStar L.P. of Charlotte, N.C.

The Leomin is slightly cationic and is preferably used in woven or knitted fabrics of cotton, wool, natural silk and treated viscose (natural and cellulosic "fibers" in general).

The Fibranol, a fatty acid condensation product (animal based, grease based, transformed when mixed with polymers), is recommended to be used in woven or knitted fabrics of synthetic fibers.

Prior to treatment of the fabric by the composition of the invention, the fabric may be backed with paper or film by means of an adhesive. The paper or film backing facilitates a proper application of the design on the fabric by maintaining the fabric in a more rigid condition, which is advantageous when both applying the composition and running the fabric through the inkjet printer. The paper or film backing can be easily removed once the dye application process has been completed so that the fabric can be loaded and shipped in an effective conventional manner. Typically, paper or film backing will not, however, be used, at least in large production runs, owing to the expense thereof.

A wide variety of backing materials may be used. These include, but are limited to, polystyrene, polyethylene, polypropylene, synthetic paper, high impact polystyrene (HIPS), and PETG. Each of these various backing materials can be in a number of forms and have a variety of properties, including, but not limited to: texturized, matte, semi-matte, clear, white, natural and black.

The backing material is applied to the fabric using a suitable glue. While a large number of different glues can be used, a particular glue may be selected based on its compatibility and effectiveness with the type of fabric with which it is used. The glue may be vegetal based, animal based or chemical based. The glue should be carefully selected according to the type of material to which it is being applied, failing which it can adversely affect the fabric both during and after the printing process. The glue must have the ability to easily separate from the fabric not only after printing has occurred, but at any time during the printing process. Moreover, the glue is preferably selected to match the type of material in that no or minimal residues remain on the fabric after it has been removed therefrom.

The invention described herein thus provides for a composition and method of applying the composition whereby a fabric is better able to receive ink dyes from a printer directly and, at the same time, hold and retain the ink such that the desired pattern has good resolution. A faded, washed out appearance of the fabric is reduced or eliminated entirely.

When the ink used is not of a permanent nature, additional treatment of the fabric after printing will be necessary. Thus, if a permanent print is desired, a suitable finishing process or step might be required to retain the dyes permanently on the fabric. However, if the ink is comprised of a pigment ink or reactive dye, a thermofixing or steaming process will usually follow.

It will be appreciated that the relative constituents of the composition may be, at least to some extent, determined according to the nature of the fabric. Thus, the proportion of any one component may be adjusted depending on whether the fabric is natural or synthetic, woven or non-woven etc.

Furthermore, the composition may contain other ingredients which improve the final product. Such ingredients may include, for example, humectants, wetting agents and dispersion stabilizers. Additionally, pigments and binders may be used in the composition, and an anti-curling agent may be incorporated.

We claim:

1. A fabric treatment composition comprising:

a fatty acid ester;

a silicone elastomer; and a polyacrylate thickening agent;

wherein the composition is used as a pre-treatment for the fabric prior to application of ink thereto to facilitate retention and resolution of the ink on the fabric.

2. A fabric treatment composition as claimed in claim 1 wherein the fatty acid ester in the form of polyethylene glycol stearate, and the silicone elastomer is a functional polysiloxane emulsion.

3. A fabric treatment composition as claimed in claim 1 further comprising water.

4. A fabric treatment composition as claimed in claim 1 wherein the polyacrylate is in the form of an emulsion.

5. A fabric treatment composition as claimed in claim 1 further comprising an antimigrant selected from vinyl ethers, vinyl halides and vinyl esters for controlling mobility of dye particles.

6. A fabric treatment composition as claimed in claim 4 wherein the polyacrylate emulsion is present in the amount of about 1% to about 20% by weight.

7. A fabric treatment composition as claimed in claim 4 wherein the polyacrylate is present in the composition in the amount of about 5% by weight.

8. A fabric treatment composition as claimed in claim 2 wherein the polyethylene glycol stearate is present in the amount of about 0.1% to about 10% by weight.

9. A fabric treatment composition as claimed in claim 8 wherein the polyethylene glycol stearate is present in the amount of about 0.5% by weight.

10. A fabric treatment composition as claimed in claim 5 wherein the antimigrant is present in the amount of about 1% to about 20% by weight.

11. A fabric treatment composition as claimed in claim 10 wherein the antimigrant is present in the amount of about 2% by weight.

12. A fabric treatment composition as claimed in claim 2 wherein the polysiloxane emulsion is present in the amount of about 30% to about 90% by weight.

13. A fabric treatment composition as claimed in claim 12 wherein the polysiloxane emulsion is present in the amount of about 75% by weight.

14. A fabric treatment composition as claimed in claim 3 wherein the water is present in the amount of about 5% to about 50% by weight.

15. A fabric treatment composition as claimed in claim 14 wherein the water is present in the amount of about 16% to about 18% by weight.

16. A fabric treatment composition comprising:

about 1% to about 20% by weight of polyacrylate emulsion;

about 0.1% to about 10% by weight of polyethylene glycol stearate;

about 1% to about 20% by weight of an antimigrant selected from vinyl ethers, vinyl halides and vinyl esters;

about 30% to about 90% by weight polysiloxane emulsion; and about 5% to about 50% by weight of water.

17. A fabric treatment composition as claimed in claim 16, comprising:

about 5% by weight of the polyacrylate emulsion;

about 0.5% by weight of the polyethylene glycol stearate;

about 2% by weight of the antimigrant selected from vinyl ethers, vinyl halides and vinyl esters;

about 75% by weight the polysiloxane emulsion; and about 16% to about 18% by weight of water.

18. A method of treating a fabric prior to printing thereon with an ink, the method comprising:

locating the fabric on a frame or base;

applying a treatment composition comprising a polyethylene glycol stearate and a silicone elastomer to the fabric; and drying the fabric immediately thereafter.

19. A method as claimed in claim 18 wherein the fabric is further located adjacent a screen having a mesh with pores therein, the treatment composition being applied so as to fill the screen with said composition.

20. A method as claimed in claim 19 wherein the composition is pushed through the open mesh to apply the composition to the fabric.

21. A method as claimed in claim 19 wherein the drying takes place at a temperature of about 250° F. to 280° F. for about one minute.

22. A method as claimed in claim 21 wherein the fabric is passed, after drying thereof, through a frame, and is held under tension in the frame.

23. A fabric treatment composition comprising:

a fatty acid ester;

a silicone elastomer; and an antimigrant selected from vinyl ethers, vinyl halides and vinyl esters for controlling mobility of dye particles, wherein the composition is used as a pre-treatment for the fabric prior to application of ink thereto to facilitate retention and resolution of the ink on the fabric.

* * * * *